United States Patent [19]

Ichiryu et al.

[11] Patent Number: 4,544,129

[45] Date of Patent: Oct. 1, 1985

[54] DIRECT-ACTING SERVO VALVE

[75] Inventors: Ken Ichiryu; Haruo Watanabe; Takashi Yamaguchi, all of Ibaraki, Japan

[73] Assignee: Hitachi, Ltd., Tokyo, Japan

[21] Appl. No.: 560,177

[22] Filed: Dec. 12, 1983

[30] Foreign Application Priority Data

Dec. 20, 1982 [JP] Japan ..... 57-222028

[51] Int. Cl.[4] ..... F15B 13/044

[52] U.S. Cl. ..... 251/129.01; 137/625.65

[58] Field of Search ..... 137/625.65, 624.15; 251/129, 65

[56] References Cited

U.S. PATENT DOCUMENTS

| | | | |
|---|---|---|---|
| 3,466,003 | 9/1969 | Boonshaft et al. | 137/625.65 X |
| 3,749,128 | 7/1973 | Sallberg et al. | 137/625.65 X |
| 3,850,196 | 11/1974 | Fales | 251/129 X |
| 4,456,031 | 6/1984 | Taplin | 137/625.64 X |

FOREIGN PATENT DOCUMENTS

| | | | |
|---|---|---|---|
| 10198 | 1/1980 | Japan | 137/625.65 |
| 10161 | 1/1980 | Japan | 137/625.65 |

*Primary Examiner*—Gerald A. Michalsky

*Attorney, Agent, or Firm*—Antonelli, Terry & Wands

[57] ABSTRACT

A direct-acting servo valve wherein a spool is directly driven by a force motor including a coiled first bobbin located in a first magnetic circuit composed of a first yoke and a first magnet mounted on the yoke includes a second magnetic circuit composed of a second yoke and a second magnet located at one end of the spool, and a third magnetic circuit composed of third magnets and a magnetic member located at the other end of the spool. The second magnetic circuit serves as means for detecting the velocity of the spool, and the third magnetic circuit serves as means for detecting the displacement of the spool.

7 Claims, 3 Drawing Figures

DIRECT-ACTING SERVO VALVE

BACKGROUND OF THE INVENTION

This invention relates to a direct-acting servo valve suitable for use with a hydraulic drive system, such as a vibration tester, rolling mill, etc.

In this type of servo valve, a spool mounted in a body for axial movement of directly driven by a force motor comprising a yoke, a permanent magnet and a bobbin. This type of servo motor is characterized in that it is highly responsive as compared with other types of servo motors by virtue of the fact that its movable section can be made light in weight. This characteristic makes it suitable for use with a hydraulic drive system, such as a vibrating table, a rolling mill, etc.

In this type of servo valve, a spring is used as mechanical means for positioning the spool, and a sensor in the form of a differential transformer is used as electrical means to attain the same as disclosed in Japanese Patent Laid-Open No. 10198/80. However, some disadvantages are associated with the prior art. When a spring is used, the valve becomes poor in response (about 600 Hz), and difficulties are experienced in achieving high response (over about 1 KHz) even if a sensor is used.

SUMMARY OF THE INVENTION

This invention has been developed for the purpose of obviating the aforesaid problem of the prior art. Accordingly, the object of present invention is to provide a direct-acting servo valve having superhigh response.

Another object is to provide a direct-acting servo valve capable of detecting the velocity and displacement of the spool of the servo valve exactly.

To accomplish the aforesaid objects, the invention provides, in a direct-acting servo valve wherein a spool is directly driven by a force motor including a coiled first bobbin located in a first magnetic circuit composed of a first yoke and a first magnet mounted on the yoke, the feature that a second magnetic circuit composed of a second yoke and a second magnet is located at one end of the spool and serves as means for detecting the velocity of the spool and a third magnetic circuit composed of third magnet and a magnetic member is located at the other end of the spool and serves as means for detecting the displacement of the spool.

DESCRIPTION OF THE PREFERRED EMBODIMENT

Figure 1:
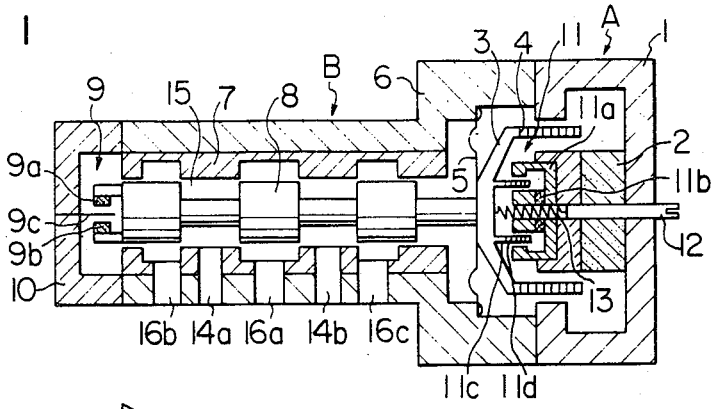
FIG. 1 is a sectional view of the direct-acting servo valve showing one embodiment of the invention.
Figure 2:
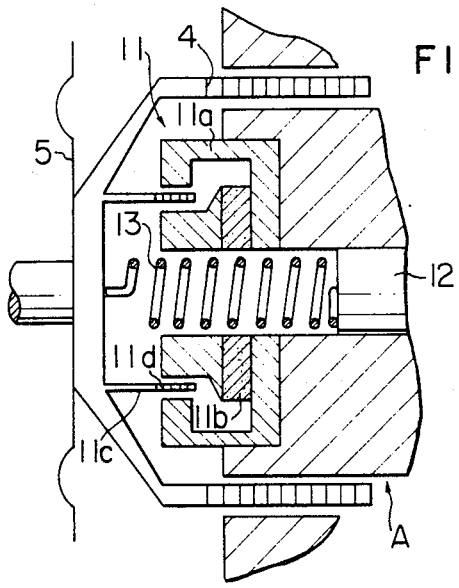
FIG. 2 is a fragmentary sectional view of the direct-acting servo valve shown in FIG. 1, showing the essential portions thereof.

In FIGS. 1 and 2, a force motor A comprises a first magnetic circuit composed of a first yoke 1 and a first permanent magnet 2 mounted in the yoke 1, and a cylindrical first bobbin 3 inserted in the yoke 1 for axial movement. The bobbin 3 is supported by a plate spring 5 attached to a body 6 as subsequently to be described. A coil 4 is wound on an outer peripheral surface of a cylindrical portion of the bobbin 3. The bobbin 3 is moved axially through the agency of the plate spring 5 as a command current is passed to the coil 4.

A hydraulic section B comprises, in addition to the aforesaid body 6 connected to the yoke 1 to provide a unitary structure, a sleeve 7 fitted to an inner peripheral surface of the body 6, and an axially slidable spool 8 contained in the sleeve 7. The spool 8 has two ends and is firmly secured at one end (right end in the figures) to the plate spring 5 while two magnets **9*a* and 9*b* forming a pair are attached to the other end (left end in the figures) and located in spaced juxtaposed relation. A magnetic resistance element 9C of high response is interposed between the pair of magnets 9*a* and 9*b* and cooperates with the magnets 9*a* and 9*b* to constitute a spool displacement detector 9** forming a third magnetic circuit.

The plate spring 5 has the function of preventing the spool 8 from rotating and of holding the spool in a neutral position in initial stages of operation. It has a spring constant which does not adversely affect the movement of the spool 8. The body 6 and sleeve 7 are formed in walls with control ports **14*a* and 14*b*, a pressure fluid supply port 16*a* and pressure fluid discharge ports 16*b* and 16*c* which allow a fluid chamber 15** to communicate with an actuator, not shown.

Mounted in the first bobbin 3 of the force motor A is a spool velocity detector 11 forming a second magnetic circuit which comprises a second yoke **11*a*, a second permanent magnet 11*b* located inwardly of the second yoke 11*a* and a second bobbin 11*c* inserted between the second yoke 11*a* and the second permanent magnet 11*b*. The bobbin 11*c* has a coil 11*d* wound on its cylindrical portion and is connected to an inner surface of a central portion of the first bobbin 3 of the force motor A to provide a unitary structure. A coil spring 13 having two ends is secured at one end to the inner surface of the central portion of the first bobbin 3 and at the other end to a neutral point adjusting member 12 of the spool 8 threadably connected to the first and second yokes 1 and 11*a* and the first and second permanent magnets 2 and 11*b*. Thus, by axially moving the neutral point adjusting member 12 to adjust the spring force of the coil spring 13, it is possible to move the spool 8 axially through the bobbin 3 of the force motor A to thereby set the spool 8** in neutral position.

When it is desired to drive the force motor A at a very high frequency over 1 KHz, the spool 8 preferably has a small diameter of about 2–5 mm and has its stroke increased. The sleeve 7 also preferably has a small outer diameter of about 5–15 mm.

Operation of the embodiment of the direct-acting servo valve of the aforesaid construction in conformity with the invention will now be described.

Before the force motor A is driven, the spool 8 is set in a neutral position. In setting the spool 8 in the neutral position, the spring force of the coil spring 13 is adjusted by turning the neutral point adjusting member 12 to adjust the spring force of the coil spring 13. This moves the spool 8 axially through the bobbin 3 until lands of the spool 8 are indexed with the ports formed in the sleeve 7, when the turning movement of the neutral point adjusting member 12 is stopped. When in this position, the spool 8 is referred to as being in its neutral position. When the spool 8 is in this position, the neutral position of the position detector 9 is electrically adjusted.

Then, a command current is passed to the coil 4 wound on the bobbin 3. This generates an axially oriented force in the bobbin 3 by the Fleming's rule because a magnetic circuit is formed between the yoke 1 and the permanent magnet 2. The force generated in the bobbin 3 moves the spool 8 axially in the sleeve 7 via the spring 5, so that the control parts 14*a* and 14*b* are alternately turned on and off to supply pressure fluid to the actuator by way of the control portion. The amount of fluid pressure supplied may vary depending on the opening formed between the ports formed in the sleeve 7 and the lands of the spool 8.

As the spool 8 moves leftwardly in the figures, the pressure fluid is supplied to the actuator through the pressure fluid supply port 16*a*, fluid chamber 15 and control port 14*b*. At this time, the velocity of the spool 8 and the displacement thereof can be exactly detected by the velocity detector 11 mounted in the force motor A and the displacement detector 9 mounted in the hydraulic section, respectively. The values detected by the two detectors 11 and 9 are utilized for effecting feedback control by a control unit subsequently to be described.

The magnetic resistance element 9*c* of the displacement detector 9 has an induced voltage which is proportional to its crossing volume with the magnetic flux generated between the two magnets 9*a* and 9*b*. Thus, the crossing volume changes with the movement of the spool 8, so that an output voltage porportional to the movement of the spool 8 is obtained. Theoretically, this output voltage depends on the magnitude of the movement of electrons of the magnetic flux, so that the response can be improved. The velocity detector 11 produces an output voltage which is proportional to the velocity of movement of the second bobbin 11*c*. Thus, the provision of the coil 11*d* to the bobbin 11*c* enables an output voltage of good S/N ratio to be produced.

The displacement detector 9 is capable of exactly detecting the displacement of the spool 8, because the magnetic resistance element 9*c* which tends to vibrate is secured to a cover 10 and the permanent magnets 9*a* and 9*b* alone move with the spool 8 as a unit. This shows a high precise response (1 KHz) in answer to any high frequency.

The first and second bobbins 3 and 11*c* are supported by the plate spring 5 and connected to the neutral point adjusting member 12 through the coil spring 13. This enables the spool 8 to be held in its neutral position by manipulating the neutral point adjusting member 12 and to be prevented from rotating by means of the plate spring 5. The precision with which the displacement detector 9 detects the displacement of the spool 8 can be increased by the function of the plate spring 5 to prevent the rotation of the spool 8. Since the first and second bobbins 3 and 11*c* are formed as a unitary structure, alignment of the bobbins 3 and 11*c* with the magnets 2 and 11*b* can be exactly obtained.

Figure 3:
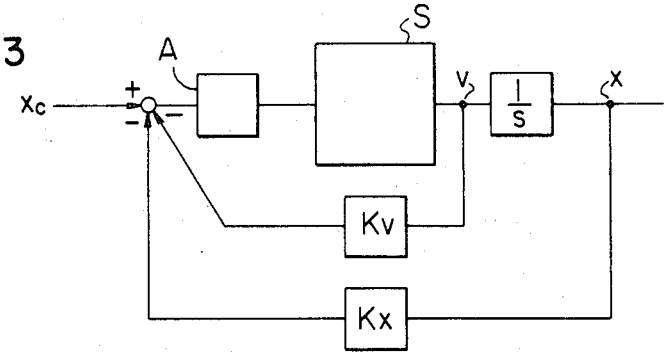
FIG. 3 is a block diagram of the control circuit of the direct-acting servo valve according to the invention.

FIG. 3 shows a block diagram of the control circuit model of the direct-acting servo valve according to the invention. As described hereinabove, a velocity v and a displacement x of the spool 8 of the servo valve S (see FIG. 1) are detected by the velocity detector 11 and displacement detector 9 respectively. The values v and x obtained are amplified by gains Kv and Kx respectively and fed back to the input side of the servo valve S for comparison with a command value Xc, to obtain a difference between them which is used as a signal for controlling the displacement of the spool 8 of the servo valve S. An amplifier A for driving the servo valve S is of the constant current drive type and has high response. The displacement detector 9 is high impedance, so that a cable for connecting the detector 9 to the amplifier A should have its length minimized, or if possible, the amplifier A should be located as close as possible to the detector 9 to vary the impedance to lead to the amplifier A.

In the embodiment of the invention shown in FIGS. 1 and 2, the velocity detector 11 is located on a side of the spool 8 on which the force motor is located and the displacement detector 9 is located on an opposite side of the spool 8 thereof. The invention is not limited, however, to this specific locational arrangement of the detectors 11 and 9, and the positions of the two detectors 11 and 9 may be reversed. When their positions are reversed, the velocity detector 11, the neutral point adjusting member 12 and the coil spring 13 et al are moved to the side of the spool 8 opposite the side thereof on which the force motor is located while the magnets 9*a* and 9*b* and the magnetic resistance element 9*c* of the displacement detector 9 are moved to the side of the spool 8 on which the force motor is located.

From the foregoing description, it will be appreciated that the direct-acting servo valve according to the invention is capable of positively detecting the velocity and displacement of the spool with a high response. Thus, by feeding back the values of the displacement and velocity detected by the detectors to a main servo system, it is possible to increase the gain and to improve the response of the system to a supper high level.

What is claimed is:

1. In a direct-acting servo valve wherein a spool is directly driven by a force motor including a coiled first bobbin located in a first magnetic circuit composed of a first yoke and a first magnet mounted on the yoke, the improvement comprising:

a second magnetic circuit composed of a second yoke and a second magnet located at one end of the spool and serving as a means for detecting the velocity of the spool; and a third magnetic circuit composed of third magnets and a magnetic member located at the other end of the spool and serving as a means for detecting the displacement of the spool.

2. A direct-acting servo valve as claimed in claim 1, wherein said means for detecting the velocity of the spool further comprises a second bobbin connected to the first bobbin of the force motor to provide a unitary structure and inserted between the second yoke and the second magnet located inwardly of the force motor constituting the first magnetic circuit.

3. A direct-acting servo valve as claimed in claim 1, wherein said means for detecting the displacement of the spool further comprises a pair of magnets located in spaced juxtaposed relation to each other at an end of the spool opposite an end thereof at which the force motor is located, and a magnetic resistance element interposed between the two magnets.

4. A direct-acting servo valve as claimed in claim 1, wherein said first bobbin is supported by a plate spring mounted on a body and connected to a neutral point adjusting member through a coil spring.

5. A direct-acting servo valve as claimed in claim 4, wherein said spool is prevented from rotating by means of said plate spring.

6. A direct-acting servo valve as claimed in claim 1, wherein means are provided for amplifying by gains and feeding back to an input side of the servo valve the values of a velocity and a displacement of the spool detected by the spool velocity detecting means and the spool displacement detecting means respectively.

7. A direct-acting servo valve comprising a valve body; a spool mounted in said valve body for axial movement; a force motor for directly driving said spool, said force motor including a coiled first bobbin located in a first magnetic circuit comprising a first yoke and a first magnet mounted on the first yoke; means for detecting the velocity of said spool, said velocity detecting means including a second magnetic circuit comprising a second yoke and a second magnet located at one end of the spool and a coiled second bobbin mounted for movement with said spool and inserted between said second yoke and said second magnet; and means for detecting the displacement of said spool, said displacement detecting means comprising third magnets and a magnetic member located at the other end of the spool, said third magnets being attached to said other end of the spool for movement with said spool and said third magnetic member being mounted on said servo valve adjacent said other end of the spool and located between said third magnets.

* * * * *